US011670830B2

(12) United States Patent
Wu et al.

(10) Patent No.: US 11,670,830 B2
(45) Date of Patent: Jun. 6, 2023

(54) RIDGE GAP WAVEGUIDE CROSSOVER STRUCTURE INCLUDING INTERSECTING TRANSMISSION LINES WITH IMPEDANCE TRANSFORMERS DISPOSED BETWEEN UPPER AND BOTTOM PLANAR METAL PLATES AND HAVING A GAP THEREIN

(71) Applicant: BEIJING UNIVERSITY OF POSTS AND TELECOMMUNICATIONS, Beijing (CN)

(72) Inventors: Yongle Wu, Beijing (CN); Jie Wang, Beijing (CN); Yuhao Yang, Beijing (CN); Weimin Wang, Beijing (CN)

(73) Assignee: BEIJING UNIVERSITY OF POSTS AND TELECOMMUNICATIONS, Beijing (CN)

( * ) Notice: Subject to any disclaimer, the term of this patent is extended or adjusted under 35 U.S.C. 154(b) by 0 days.

(21) Appl. No.: 17/491,423

(22) Filed: Sep. 30, 2021

(65) Prior Publication Data

US 2022/0166119 A1 May 26, 2022

(30) Foreign Application Priority Data

Nov. 23, 2020 (CN) ..... 202011319497.5

(51) Int. Cl.
*H01P 3/123* (2006.01)
*H01P 1/02* (2006.01)
*H01P 3/08* (2006.01)

(52) U.S. Cl.
CPC ..... *H01P 3/123* (2013.01); *H01P 1/022* (2013.01); *H01P 3/081* (2013.01)

(58) Field of Classification Search
CPC ..... H01P 3/123
(Continued)

(56) References Cited

U.S. PATENT DOCUMENTS

2020/0076395 A1* 3/2020 Kamo et al. ..... H01Q 13/10

FOREIGN PATENT DOCUMENTS

CN 101752638 A 6/2010
CN 106537682 A 3/2017
(Continued)

OTHER PUBLICATIONS

Mohamed Mamdouh M. Ali et al., "Design of Printed RGW Crossover for Millimeter Wave Beam Switching Network", 789-1-7281-0695-3/19, IEEE URSI 2019.*

*Primary Examiner* — Benny T Lee
(74) *Attorney, Agent, or Firm* — Pai Patent & Trademark Law Firm; Chao-Chang David Pai

(57) ABSTRACT

A ridge gap waveguide millimeter-wave crossover bridge structure device includes: an upper planar metal plate and a bottom planar metal plate arranged in parallel; a supporting structure fixedly arranged between the two planar metal plates; a ridge waveguide fixed on the upper surface of the bottom planar metal plate, with an air gap between the upper planar metal plate and the ridge waveguide; and a plurality of metal pins fixed on the upper surface of the bottom planar metal plate and evenly arranged around the ridge waveguide. The ridge waveguide includes two transmission lines arranged crosswise and four impedance transformation structures respectively connected to the ends of the two transmission lines. The distal end of each of the impedance transformation structures away from the connected transmission line is used to connect with external test equipment to be accommodated in four input ports in the bottom planar metal plate.

10 Claims, 3 Drawing Sheets

(58) Field of Classification Search
USPC ..... 333/248, 1
See application file for complete search history.

(56) References Cited

FOREIGN PATENT DOCUMENTS

| | | | | |
|---|---|---|---|---|
| CN | 206639901 | U | * | 11/2017 |
| CN | 110492212 | A | | 11/2019 |
| CN | 110783680 | A | * | 2/2020 |
| CN | 111063975 | A | * | 4/2020 |
| CN | 111540996 | A | * | 8/2020 |
| WO | 2015/172948 | A2 | * | 11/2015 |
| WO | 2015/172948 | A3 | * | 11/2015 |

* cited by examiner

RIDGE GAP WAVEGUIDE CROSSOVER STRUCTURE INCLUDING INTERSECTING TRANSMISSION LINES WITH IMPEDANCE TRANSFORMERS DISPOSED BETWEEN UPPER AND BOTTOM PLANAR METAL PLATES AND HAVING A GAP THEREIN

BACKGROUND OF THE INVENTION

Field of the Invention

The invention relates to the technical field of millimeter-wave radio frequency antennas, in particular to a ridge gap waveguide millimeter-wave crossover bridge structure device and a center-structure module for the same.

Description of the Prior Art

In recent years, millimeter waves have received extensive attention and research due to their obvious advantages. The advantages of millimeter waves include rich spectrum resources, good directivity, available frequency bandwidth, and short wavelength. In addition, it is easier for millimeter-wave devices to achieve miniaturization and integration. Millimeter-wave applications are comprehensive, not only used in industrial automation, telemedicine, aviation, and communications, but also in mobile communications coverage, such as 5G (fifth generation) communications. Millimeter-wave is an important part of 5G communication system, and millimeter-wave has great potential in 5G communication system. Therefore, devices based on millimeter-wave technology will also be more favored.

As the complexity and component density of millimeter-wave circuits continue to increase, millimeter-wave devices tend to be more and more miniaturized and integrated. At present, in an antenna and beamforming network, the crossover bridge structure is an indispensable part. The crossover bridge structure can be used for signal distribution and selection, and for the development of high-performance orthogonal transmission circuits. It is characterized in that in the same planar structure, when two signals inevitably cross each other's path (two signal paths cross each other), the crossover bridge structure can have high transmission and high isolation at the same time. In the related art, a variety of crossover bridge structures can be designed using microstrip line technology. However, the existing crossover bridge structures have problems such as difficulty in manufacturing, excessive insertion loss, and poor transmission effect.

SUMMARY OF THE INVENTION

The purpose of the present invention is to provide a ridge gap waveguide millimeter-wave crossover bridge structure device and a center-structure module to reduce the insertion loss of the crossover bridge structure, improve the transmission effect of the crossover bridge structure, and reduce the processing difficulty of the crossover bridge structure. The specific technical solutions are as follows:

In order to achieve the foregoing objective, the embodiment of the invention provides a ridge gap waveguide millimeter-wave crossover bridge structure device, which includes: an upper planar metal plate and a bottom planar metal plate arranged in parallel; a supporting structure fixedly arranged between the upper planar metal plate and the bottom planar metal plate; a ridge waveguide fixed on the surface of the bottom planar metal plate facing the upper planar metal plate, with an air gap between the upper planar metal plate and the ridge waveguide. The ridge waveguide includes two transmission lines arranged crosswise and four impedance transformation structures respectively connected to the ends of the two transmission lines. The distal end of each of the impedance transformation structures away from the connected transmission line is used to connect with external test equipment for testing the performance of the device.

Four input ports are opened in the bottom planar metal plate and are each located around the side of a respective impedance transformation structure away from the connected transmission line.

A plurality of metal pins are fixed on the surface of the bottom planar metal plate facing the upper planar metal plate with an air gap between the upper planar metal plate and the metal pins, and are evenly arranged around the edges of the ridge waveguide to form a wave stop-band.

The two transmission lines arranged in a crisscross pattern form four corners or intersecting angles around the area where the two transmission lines cross each other; among them, two of the diagonally opposite corners are chamfered with a chamfer edge.

Some embodiments further include two pins fixed on the surface of the bottom planar metal plate facing the upper planar metal plate, and the height of the two pins is the same as the height of the plurality of metal pins. The two pins each include a surface opposite to the chamfer edge of one of the chamfered corners.

In some embodiments, the chamfer edge has an inclined surface. The two pins are each in the shape of a triangular prism with one of the side surfaces opposite to the inclined surface of the chamfer edge of one of the chamfered corners.

In some embodiments, the impedance transformation structures each includes a first transformation sub-structure and a second transformation sub-structure. One end of the first transformation sub-structure is connected to the transmission line, the other end is connected to one end of the second transformation sub-structure, and the other end of the second transformation sub-structure (corresponding to the distal end of the impedance transformation structure) is used to connect to the external test equipment.

The width of the transmission line, the size of the first transformation sub-structure parallel to the width direction of the transmission line, and the size of the second transformation sub-structure decreases sequentially in the direction parallel to the width of the transmission line.

In some embodiments, the junction between the first transformation sub-structure and the transmission line has a rounded or chamfered corner.

In some embodiments, the supporting structure includes a plurality of supporting pins. The plurality of the supporting pins are fixed on the surface of the bottom planar metal plate facing the upper planar metal plate, and are distributed over the outer corners of the bottom planar metal plate. Alternatively, the plurality of the supporting pins are fixed on the surface of the upper planar metal plate facing the bottom planar metal plate, and are distributed over all the corners of the upper planar metal plate.

In order to achieve the foregoing objective, the embodiment of the invention also provides a center-structure module for the above-mentioned ridge gap waveguide millimeter-wave crossover bridge structure devices, including: an upper planar metal plate and the bottom planar metal plate arranged in parallel; a ridge waveguide fixed on the surface of the bottom planar metal plate facing the upper planar metal plate with an air gap between the upper planar metal plate and the ridge waveguide; and a plurality of metal pins fixed on the surface of the bottom planar metal plate facing the upper planar metal plate and evenly arranged around the edges of the ridge waveguide to form a wave stop-band, with an air gap between the upper planar metal plate and the metal pins. The ridge waveguide includes two transmission lines arranged in a crisscross pattern to define four corners around the area where the two transmission lines cross each other, including two diagonally opposite chamfered corners. The center-structure module may have four wave port feeding pieces respectively connected to the two transmission lines.

In the ridge gap waveguide millimeter-wave crossover bridge structure device and the center-structure module provided by the present invention, the plurality of metal pins fixed on the bottom planar metal plate and evenly arranged around the ridge waveguide are used to form a wave stop-band; the air gap between the upper planar metal plate and the transmission line is used by electromagnetic waves as the propagation medium to transmit along the crosswise arranged transmission lines. Therefore, the crossover bridge structure device according to the present invention reduces the leakage of electromagnetic waves, improves the transmission effect of the crossover bridge structure, and reduces the insertion loss of the crossover bridge structure.

Of course, implementing any product or method of the present invention does not necessarily need to achieve all the advantages described above at the same time.

BRIEF DESCRIPTION OF THE DRAWINGS

In order to more clearly illustrate the embodiments of the invention, the accompanying drawings used in the description of the embodiments are briefly introduced.

DETAILED DESCRIPTION OF THE PREFERRED EMBODIMENT

The technical solutions in the embodiments of the present invention will be clearly and completely described in conjunction with the accompanying drawings of the embodiments of the present invention.

Figure 1:
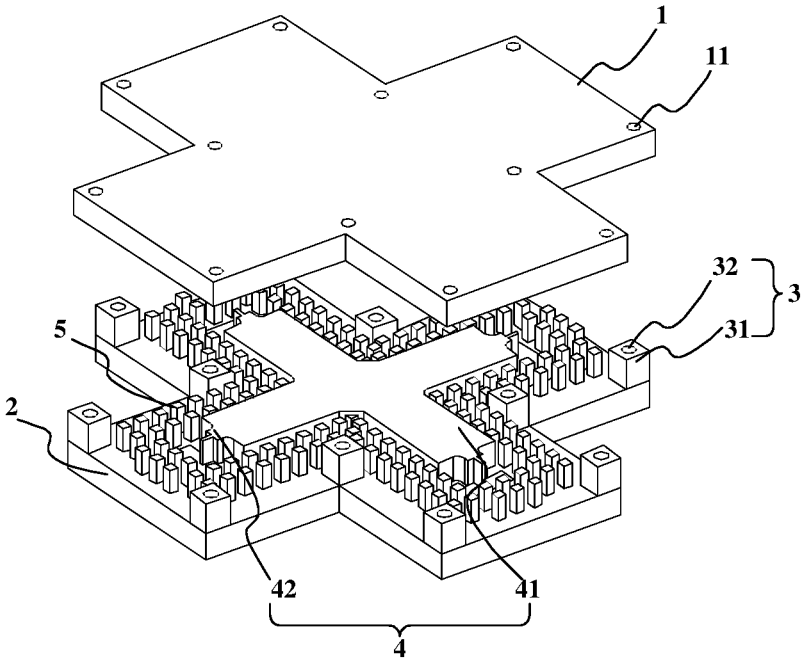
FIG. 1 is a three-dimensional structure diagram of a ridge gap waveguide millimeter-wave crossover bridge structure device according to a preferred embodiment of the present invention.

In order to reduce the insertion loss of the crossover bridge structure, improve the transmission effect of the crossover bridge structure, and reduce the processing difficulty of the crossover bridge structure, the present invention provides a ridge gap waveguide millimeter-wave crossover bridge structure device. With reference to FIG. 1, the ridge gap waveguide millimeter-wave crossover bridge structure device provided by the present invention includes:

an upper planar metal plate 1 and a bottom planar metal plate 2 arranged in parallel;

a supporting structure 3 fixedly arranged between the upper planar metal plate 1 and the bottom planar metal plate 2;

a ridge waveguide 4 fixed on the surface of the bottom planar metal plate 2 facing the upper planar metal plate 1, with an air gap between the upper planar metal plate 1 and the ridge waveguide 4; and a plurality of metal pins 5 fixed on the surface of the bottom planar metal plate 2 facing the upper planar metal plate 1 and evenly arranged around the edges of the ridge waveguide 4 to form a wave stop-band, with an air gap between the upper planar metal plate 1 and the metal pins 5.

The ridge waveguide 4 includes two transmission lines 41 arranged crosswise and four impedance transformation structures 42 fixedly connected to the ends of the two transmission lines 41, respectively. The distal end of each of the four impedance transformation structures 42 away from the connected transmission line 41 is used to connect with external test equipment for testing the performance of the device. It is noted that the each of the transmission lines is a structure having a height and a width, and is not a "line" in the strict sense.

Figure 2:
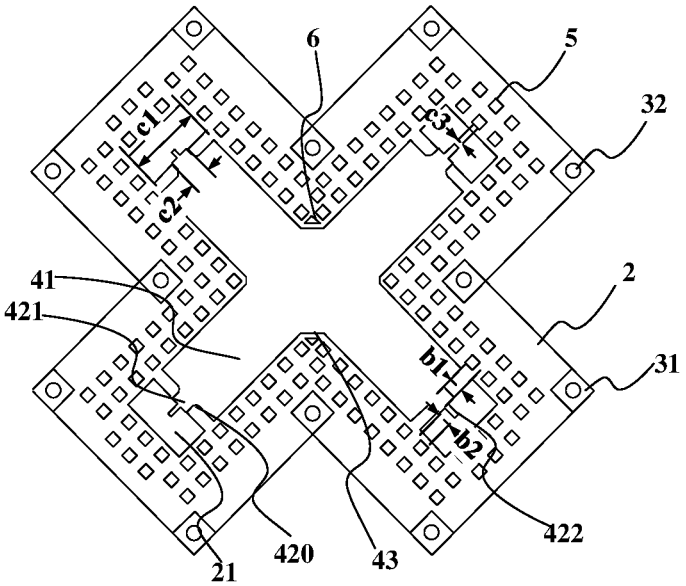
FIG. 2 is a top view of the bottom planar metal plate, the ridge waveguide and a plurality of metal pins according to the embodiment of the present invention shown in FIG. 1.

Furthermore, as shown in FIG. 2, four input ports 21 are opened in the bottom planar metal plate 2, and each of the input ports 21 is located around the side of the impedance transformation structure 42 (FIG. 1) away from the connected transmission line 41 for accommodating the external test equipment.

In the embodiment of the present invention, as shown in FIG. 1, the supporting structure 3 is located between the upper planar metal plate 1 and the bottom planar metal plate 2 to fix the upper planar metal plate 1 and the bottom planar metal plate 2. In FIG. 1, both the upper planar metal plate 1 and the bottom planar metal plate 2 take the shape of a cross consisting of two intersecting rectangles. As each of the two rectangles has four outer corners, there are a total of eight outer corners of 90 degrees each in the cross. Besides, the two intersecting rectangles form four intersected corners of over 180 degrees at points where the two rectangles intersect each other. The supporting structures 3 are respectively disposed at the outer corners and the intersected corners of the upper planar metal plate 1 or the bottom planar metal plate 2. The ridge waveguide 4 is fixed on the bottom planar metal plate 2 and is spaced by an air gap from the upper planar metal plate 1. That is, there is an air gap between the ridge waveguide 4 and the upper planar metal plate 1, so that electromagnetic waves can be propagated using air as the propagation medium.

The ridge waveguide 4 includes two transmission lines 41, which are arranged crosswise to realize the cross transmission of electromagnetic waves. The ridge waveguide 4 is used to transmit electromagnetic waves in the quasi-TEM mode. When the transmitted electromagnetic waves of the ridge waveguide 4 is fed from an external test equipment, the electromagnetic waves are in the TE mode. Therefore, an impedance transformation structure 42 is connected to each end of each of the two transmission lines 41, and the impedance transformation structure 42 is used to realize the transformation of the electromagnetic wave from the TE mode to the quasi-TEM mode. It is noted that the present invention does not specifically limit the manner in which the ridge waveguide 4 and the bottom planar metal plate 2 are connected.

In the embodiment of the present invention, as shown in FIG. 2, the four input ports 21 opened in the bottom planar metal plate 2 can be four rectangular vias, so that the interface of the test equipment can be connected to the impedance transformation structure 42 (FIG. 1) through the input ports 21. However, the shape of the input ports 21 can vary according to the interface shape of the test equipment, which is not specifically limited in the embodiment of the present invention.

In the embodiment of the present invention shown in FIGS. 1 and 2, a plurality of metal pins 5 are arranged around the edges of the ridge waveguide 4 to form a wave stop-band, so that electromagnetic waves are transmitted along the ridge waveguide 4. In order to improve the wave-blocking performance of the plurality of metal pins 5, as shown in FIG. 2, the plurality of metal pins 5 are evenly arranged around the edges of the ridge waveguide 4, and two rows of metal pins 5 are arranged on each side of the ridge waveguide 4. Nevertheless, the number of rows of metal pins 5 on each side of the ridge waveguide 4 can vary according to actual needs, such as three rows or four rows, and is not specifically limited in the embodiment of the present invention.

The height of the metal pin 5 can be set according to actual needs. The height of the metal pin 5 can be higher than the height of the ridge waveguide 4, or lower than or equal to the height of the ridge waveguide 4, which is not specifically limited.

In the above-mentioned ridge gap waveguide millimeter-wave crossover bridge structure device, the ridge waveguide 4 includes two transmission lines 41 and four impedance transformation structures 42. One end of each of the impedance transformation structure 42 is connected to the associated transmission line 41, and the other end is used to connect to an external test equipment for testing the performance of the ridge gap waveguide millimeter-wave crossover bridge structure device through the impedance transformation structure 42. A plurality of metal pins 5, as shown in FIG. 2, are fixed on the bottom planar metal plate 2 and are evenly arranged around the ridge waveguide 4 to form a wave stop-band. There is an air gap between the upper planar metal plate 1 and the two transmission lines 41, so that the electromagnetic waves use air as the propagation medium to transmit along the crosswise arranged transmission lines 41. As a result, the ridge gap waveguide millimeter-wave crossover bridge structure device of the present invention reduces the leakage of electromagnetic waves, improves the transmission effect of the crossover bridge structure, and reduces the insertion loss of the crossover bridge structure.

In some embodiments of the present invention, the two transmission lines 41 are arranged in a crisscross pattern (for example, in the shape of a cross as shown in FIG. 1) to form four corners (or intersecting angles) around the area where the two transmission lines 41 cross each other, namely, two pairs of diagonally opposite corners, and one pair of the diagonally opposite corners are chamfered. Specifically, the two chamfered corners each have a chamfer edge 43, as shown in FIG. 2. A chamfering process is performed on the two corners to form a chamfer edge 43 for each of the two chamfered corners. One of the two pairs of diagonally opposite corners is chamfered, that is, in the direction from left to right in FIG. 2, the overlapping part of the two transmission lines 41 in the ridge waveguide 4 is widened, so that the electromagnetic wave can be better transmitted in the direction of the two transmission lines 41. Thereby, the return loss and isolation of the crossover bridge structure are improved, and the insertion loss of the crossover bridge structure is reduced.

In some embodiments of the present invention, the ridge gap waveguide millimeter-wave crossover bridge structure device further includes two pins 6 fixed on the surface of the bottom planar metal plate 2 facing the upper planar metal plate 1, and the height of the two pins 6 is the same as the height of the metal pins 5 as shown in FIG. 2. Moreover, each pin 6 is located at one of the chamfered corners and includes a surface opposite to the chamfer edge 43.

Because two diagonally opposite corners are chamfered, the shapes of the two corners are changed. More importantly, since there are no metal pins 5 to block electromagnetic wave leakage in the vicinity of the chamfer edge 43, the addition of the pins 6 matching the shape of the chamfer edge 43 near the chamfer edge 43 can effectively prevent the electromagnetic wave passing through the chamfer edge 43 from leaking, and further improve the transmission effect of the crossover bridge structure.

In some embodiments of the present invention, the chamfer edge 43 may have an inclined surface, such as one inclined at 45-degree. The two pins 6 each have a triangular prism shape with one side surface matching the inclined surface of the chamfer edge 43, and placed opposite to the chamfer edge 43. In order to facilitate processing, the shape of the pins 6 can also be set to a right-angled triangular prism.

The performance of the ridge gap waveguide millimeter-wave crossover bridge structure device of the present invention will be presented in detail below in conjunction with the simulation results of insertion loss, isolation, and return loss.

Figure 3:
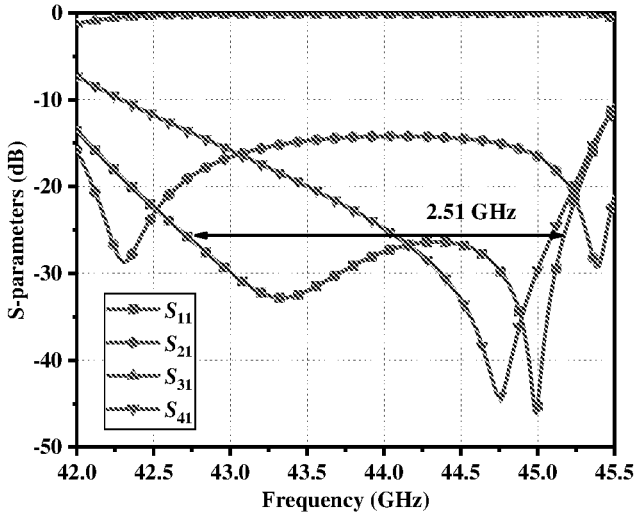
FIG. 3 shows the simulation results of insertion loss, isolation, and return loss of a ridge gap waveguide millimeter-wave crossover bridge structure device according to the embodiment of the present invention.

FIG. 3 shows the simulation results of the insertion loss, isolation, and return loss of the ridge gap waveguide millimeter-wave crossover bridge structure device provided by the embodiment of the invention. In FIG. 3, the abscissa represents the frequency in GHz, the ordinate represents the S-parameter values in dB. $S_{11}$ represents the return loss, $S_{21}$ represents the isolation between input port and a first isolated port, $S_{31}$ represents the insertion loss, and $S_{41}$ represents the isolation between input port and a second isolated port.

It can be seen from FIG. 3 that when the center frequency of the ridge gap waveguide millimeter-wave crossover bridge structure device according to the embodiment of the present invention is 43.75 GHz, and the preset working frequency range is 42 GHz-45.5 GHz (that is, the bandwidth is 3.5 GHz), the relative bandwidth is about 8% (that is, the ratio of the bandwidth to the center frequency). In the 42.66 GHz-45.17 GHz operating frequency band (corresponding to bandwidth 2.51 GHz), the return loss and the second isolation are both lower than −25 dB, and the insertion loss is higher than −0.2 dB. It can be seen that the ridge gap waveguide millimeter-wave crossover bridge structure device according to the embodiments of the present invention has the advantages of high isolation, high return loss, and low insertion loss.

Figure 4:
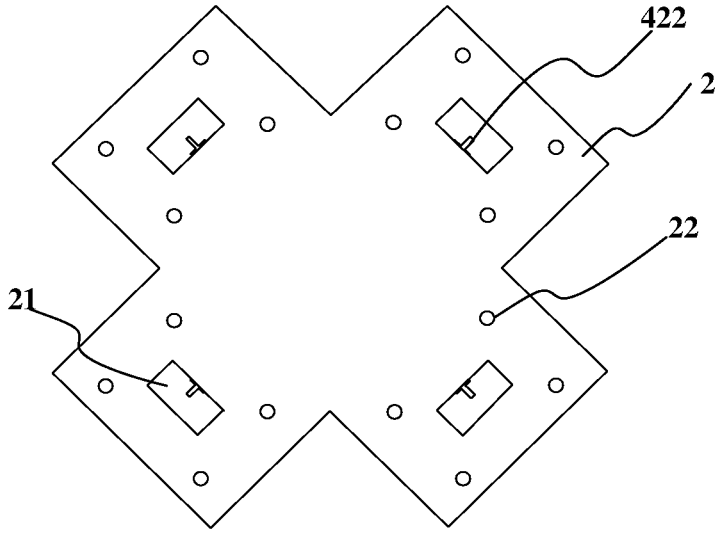
FIG. 4 is a bottom view of a ridge gap waveguide millimeter-wave crossover bridge structure device according to the embodiment of the present invention.

FIG. 4 shows a bottom view of a ridge gap waveguide millimeter-wave crossover bridge structure device according to the embodiment of the present invention. The four input ports 21, which are opened in the bottom planar metal plate 2, can be four rectangular vias.

In some embodiments of the present invention, the impedance transformation structure 42 (FIG. 1) includes a first transformation sub-structure 421 and a second transformation sub-structure 422 as shown in FIG. 2. One end of the first transformation sub-structure 421 is connected to the transmission line 41, the other end is connected to one end of the second transformation sub-structure 422, and the other end of the second transformation sub-structure 422 (corresponding to the distal end of the impedance transformation structure 42) is used to connect to an external test equipment. The width c1 of the transmission line 41, the dimension c2 of the first transformation sub-structure 421 parallel to the width direction of the transmission line 41, and the dimension c3 of the second transformation sub-structure 422 decreases sequentially in the direction parallel to the width of the transmission line 41. Simply put, the width c1 of the transmission line 41 is larger than the width (c2) of the first transformation sub-structure 421, and the width (c2) of the first transformation sub-structure 421 is larger than the width (c3) of the second transformation sub-structure 422. It is noted that the connection between the first transformation sub-structure 421 and the second transformation sub-structure 422 cannot be seen in the bottom view of the crossover bridge structure device in FIG. 4.

In the embodiment of the present invention as shown in FIG. 2, the first transformation sub-structure 421 is horizontally connected with the second transformation sub-structure 422, and the second transformation sub-structure 422 is used to connect to an external test equipment. Since the size of the first transformation sub-structure 421 is different from the size of the second transformation sub-structure 422, the value of characteristic impedance matching provided during the conversion of the electromagnetic wave from the TE mode to the quasi-TEM mode is also different. However, it is noted that the combination of two transformation sub-structures with different sizes enables the impedance transformation structure 42 to have a better parameter conversion effect.

In practice, the values of c1, c2, and c3 can be set according to actual conditions, which are not specifically limited in the embodiment of the present invention. In an example as shown in FIG. 2, c1 is 4.78 mm, c2 is 1.3 mm, the dimension b1 of the first transformation sub-structure 421 in a direction parallel to the transmission line 41 is 0.9 mm, c3 is 0.3 mm, and the dimension b2 of the second transformation sub-structure 422 in a direction parallel to the transmission line 41 is 0.9 mm.

In some embodiments of the present invention as shown in FIG. 2, the junction between the first transformation sub-structure 421 and the transmission line 41 is a rounded or chamfered corner 420. Corner rounding (or chamfering) is performed at the junction between the first transformation sub-structure 421 and the transmission line 41 to make the signal transmission more stable and facilitate the processing of the impedance transformation structure 42. The size of the rounded or chamfered portion can be determined according to actual needs. In an example, the rounded portion may be a circular arc of 90° with a radius of 0.5 mm, and the rounded portion may also have other sizes such as 0.8 mm (in radius), which are not specifically limited in the embodiment of the present invention.

In some embodiments of the present invention, the upper planar metal plate 1 and the bottom planar metal plate 2 are both shaped in a crisscross pattern, for example, in the shape of a cross, as shown in FIG. 1.

In the embodiment of the present invention shown in FIGS. 1 and 2, since the ridge waveguide 4 includes two transmission lines 41 arranged in a crisscross pattern, so that the two transmission lines 41 cross each other, the ridge waveguide 4 has a cross shape. To facilitate processing, the upper metal plate 1 and the bottom metal plate 2 are both formed in a cross shape that matches the shape of the ridge waveguide 4 but are larger than the ridge waveguide 4 as shown in FIG. 1. In this way, the overall volume of the ridge gap waveguide millimeter-wave crossover bridge structure device is smaller, requiring less materials and therefore lower manufacturing cost.

In some embodiments of the present invention, the supporting structure 3 includes a plurality of supporting pins 31 (FIGS. 1 and 2) fixed on the surface of the bottom planar metal plate 2 facing the upper planar metal plate 1 (or alternatively on the surface of the upper planar metal plate 1 facing the bottom planar metal plate 2). The plurality of supporting pins 31 are used to fixedly connect the upper planar metal plate 1 and the bottom planar metal plate 2. In order to provide an air gap between the upper planar metal plate 1 and the ridge waveguide 4 and the plurality of metal pins 5, the height of the support pins 31 is greater than the height of the ridge waveguide 4 and the plurality of metal pins 5. The plurality of supporting pins 31 are evenly distributed among the eight outer corners and the four intersected corners of the upper planar metal plate 1 or the bottom planar metal plate 2, so that the connection between the upper planar metal plate 1 and the lower planar metal plate 2 is stable.

In the embodiment of the present invention, when the supporting pins 31 are fixed on the bottom planar metal plate 2, a first screw hole 32 (FIGS. 1 and 2) can be opened on each supporting pin 31, and a second screw hole 11 (FIG. 1) matching the first screw hole 32 can be opened on the upper planar metal plate 1. As shown in FIG. 1, a screw is screwed into the first screw hole 32 through the second screw hole 11 to fix and connect the upper planar metal plate 1 and the bottom planar metal plate 2. The upper planar metal plate 1 and the bottom planar metal plate 2 can also be connected in other ways, which are not specifically limited in the embodiment of the present invention.

In the embodiments of the present invention, when the ridge gap waveguide millimeter-wave crossover bridge structure device according to the embodiment of the present invention is tested, the ridge gap waveguide millimeter-wave crossover bridge structure device needs to be fixed on a test flange (not shown). To accomplish this, a plurality of threaded blind holes 22 can be provided on the surface of the bottom planar metal plate 2 facing away from the upper planar metal plate 1, as shown in FIG. 4, so that the bottom planar metal plate 2 may be threadedly connected with the test flange.

Figure 5:
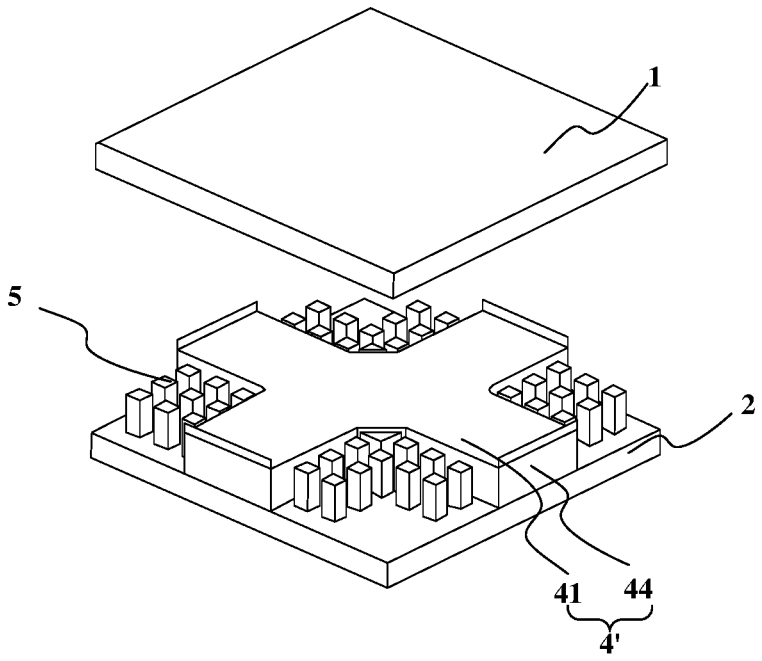
FIG. 5 is a three-dimensional structure diagram of a center-structure module for the ridge gap waveguide millimeter-wave crossover bridge structure device according to a preferred embodiment of the present invention.

In order to reduce the insertion loss of the crossover bridge structure, improve the transmission effect of the crossover bridge structure, and reduce the processing difficulty of the crossover bridge structure, the present invention also provides a center-structure module, which may be used in the above-mentioned ridge gap waveguide millimeter-wave crossover bridge structure device. As shown in FIG. 5, the center-structure module includes:

an upper planar metal plate 1 and the bottom planar metal plate 2 arranged in parallel;

a ridge waveguide 4' fixed on the surface of the bottom planar metal plate 2 facing the upper planar metal plate 1 with an air gap between the upper planar metal plate 1 and the ridge waveguide 4'; and a plurality of metal pins 5 fixed on the surface of the bottom planar metal plate 2 facing the upper planar metal plate 1 and evenly arranged around the edges of the ridge waveguide 4' to form a wave stop-band, with an air gap between the upper planar metal plate 1 and the metal pins 5.

The ridge waveguide 4' includes two transmission lines 41 arranged in a crisscross pattern, defining four corners or intersecting angles around the area where the two transmission lines cross each other. Two diagonally opposite ones of the four corners are chamfered and each have a chamfer edge 43 as shown in FIG. 2.

In addition to the center-structure module described above, FIG. 5 also shows four wave port feeding pieces 44 respectively connected to the ends of the two transmission lines 41. The four wave port feeding pieces 44 are used to input electromagnetic waves into the transmission line 41.

When electromagnetic waves are passed to the above-mentioned center-structure module, a plurality of metal pins 5 are fixed on the bottom planar metal plate 2 and are evenly arranged around the ridge waveguide 4 to form a wave stop-band. The air gap is formed between the upper planar metal plate 1 and the transmission line 41, so that the electromagnetic wave is transmitted along the cross-placed transmission line 41 using air as the propagation medium, which reduces electromagnetic wave leakage and has a better transmission effect and lower insertion loss.

Figure 6:
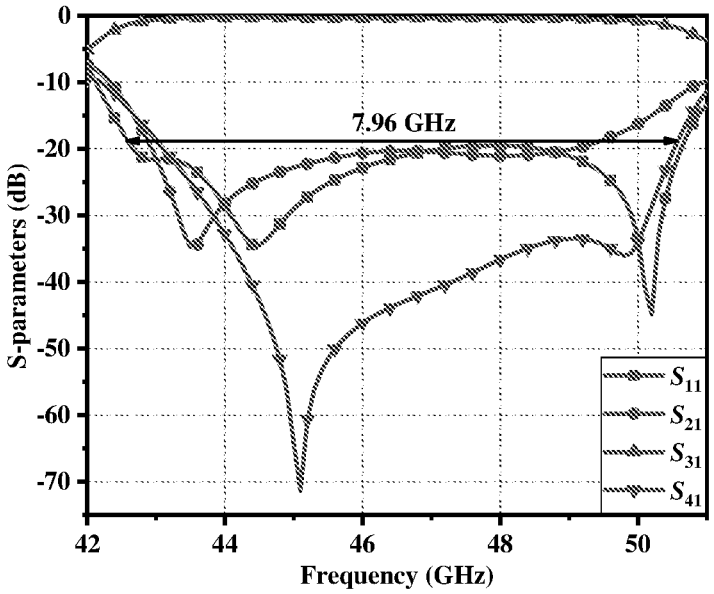
FIG. 6 is a schematic diagram of simulation results of insertion loss, isolation, and return loss of the center-structure module according to the embodiment of the present invention.

FIG. 6 shows the simulation results of the insertion loss, isolation, and return loss of the center-structure module when connected to the four wave port feeding pieces 44. In FIG. 6, the abscissa represents the frequency in GHz, the ordinate represents the various S-parameter values in dB. $S_{11}$ represents the return loss, $S_{21}$ represents the isolation between input port and a first isolated port, $S_{31}$ represents the insertion loss, and $S_{41}$ represents the isolation between input port and a second isolated port.

It can be seen that when the center frequency of the center-structure module is 46.5 GHz and the preset working frequency range is 42 GHz-51 GHz (that is, the bandwidth is 9 GHz), the relative bandwidth of the center-structure module is about 19.35%, which is relatively wide. In the working frequency range of 42.61 GHz-50.57 GHz (corresponding to bandwidth 7.96 GHz), the relative bandwidth of the center-structure module is about 17.11%, the return loss and the second isolation are both lower than −19 dB, and the insertion loss is higher than −0.5 dB. Further, it can be seen that the center-structure module has the advantages of high relative bandwidth, high isolation, high return loss, and low insertion loss.

In addition, the center-structure module can be extended to form other devices with center-structure module. The center-structure module can also be used for Butler Matrix component to form a multi-beam antenna based on Butler Matrix components.

It should be noted that in the description above, relational terms such as first and second are only used to distinguish one entity or operation from another, and do not necessarily require or imply any such actual relationship or order between these entities or operations. Moreover, the terms "including" or any other variation are intended to cover nonexclusive inclusion, so that a process, method, article or device that includes a series of elements includes not only those elements, but also other elements that are not explicitly listed, or elements inherent in such process, method, article or device. Without further limitation, the element defined by the sentence "including a . . . " does not exclude the existence of other identical elements in the process, method, article or equipment including the element.

The above description is only a preferred embodiment of the invention and is not intended to limit the protection scope of the invention. Any modification, equivalent replacement, improvement, etc. made within the spirit and principles of the invention are included in the protection scope of the invention.

We claim:

1. A ridge gap waveguide millimeter-wave crossover bridge structure device, comprising:

an upper planar metal plate and a bottom planar metal plate arranged in parallel;

a supporting structure fixedly arranged between the upper planar metal plate and the bottom planar metal plate;

a ridge waveguide fixed on a surface of the bottom planar metal plate facing but not contacting the upper planar metal plate, wherein the ridge waveguide includes two transmission lines arranged crosswise with respect to each other and four impedance transformation structures, one of the two transmission lines having two ends respectively connected to two of the four impedance transformation structures, the other of the two transmission lines having two ends respectively connected to the other two of the four impedance transformation structures, each of the impedance transformation structures having a distal end for external connection;

four input ports opened in the bottom planar metal plate and respectively located around the distal ends of the four impedance transformation structures; and a plurality of metal pins fixed on the surface of the bottom planar metal plate facing but not contacting the upper planar metal plate, wherein the plurality of metal pins are evenly arranged around the ridge waveguide, wherein an air gap is present between the ridge waveguide and the plurality of metal pins on the bottom planar metal plate and the upper planar metal plate.

2. The ridge gap waveguide millimeter-wave crossover bridge structure device as claimed in claim 1, wherein four corners are defined around an area where the two transmission lines cross each other; and two of the four corners are diagonally opposite to each other and each of the two of the four corners comprises a chamfered corner with a chamfer edge.

3. The ridge gap waveguide millimeter-wave crossover bridge structure device as claimed in claim 2, further comprising two pins fixed on the surface of the bottom planar metal plate and facing the upper planar metal plate, wherein the height of the two pins is the same as the height of the plurality of metal pins, and each of the two pins has a respective surface opposite to the chamfer edge of a respective one of the two chamfered corners.

4. The ridge gap waveguide millimeter-wave crossover bridge structure device as claimed in claim 3, wherein the chamfer edge of each of the two chamfered corners has an inclined surface, and each of the two pins has a shape of a triangular prism with one side surface of the triangular prism opposite to the inclined surface of the chamfer edge of a respective one of the two chamfered corners.

5. The ridge gap waveguide millimeter-wave crossover bridge structure device as claimed in claim 2, wherein each of the upper planar metal plate and the bottom planar metal plate has a shape of a cross consisting of two intersecting rectangles, each of the two intersecting rectangles having eight outer corners of 90 degrees each, the two intersecting rectangles forming four interior intersected corners, where the two intersecting rectangles intersect.

6. The ridge gap waveguide millimeter-wave crossover bridge structure device as claimed in claim 5, wherein the supporting structure comprises a plurality of supporting pins fixed on the surface of the bottom planar metal plate facing the upper planar metal plate and respectively located at the eight outer corners and the four intersected corners of the two intersecting rectangles corresponding to the shape of the bottom planar metal plate.

7. The ridge gap waveguide millimeter-wave crossover bridge structure device as claimed in claim 1, wherein each of the four impedance transformation structures comprises a first transformation sub-structure and a second transformation sub-structure, wherein the first transformation sub-structure has a first end connected to the corresponding transmission line and a second end connected to a first end of the second transformation sub-structure, and the second transformation sub-structure has a second end corresponding to the distal end of the corresponding impedance transformation structure; and the first transformation sub-structure is narrower than the corresponding transmission line, and the first transformation sub-structure is wider than the second transformation sub-structure.

8. The ridge gap waveguide millimeter-wave crossover bridge structure device as claimed in claim 7, wherein two corners are formed where the first transformation sub-structure of each of the four impedance transformation structures is connected to the corresponding transmission line, and the two corners are rounded or chamfered.

9. A center-structure module for a ridge gap waveguide millimeter-wave crossover bridge structure device, comprising:

an upper planar metal plate and a bottom planar metal plate arranged in parallel;

a ridge waveguide fixed on a surface of the bottom planar metal plate facing but not contacting the upper planar metal plate, wherein the ridge waveguide includes two transmission lines arranged crosswise with respect to each other, each of the two transmission lines having two ends for respectively connecting to two respective wave port feeding pieces;

a plurality of metal pins fixed on the surface of the bottom planar metal plate facing but not contacting the upper planar metal plate, wherein the plurality of metal pins are evenly arranged around the ridge waveguide; and two pins fixed on the surface of the bottom planar metal plate facing the upper planar metal plate, wherein the height of the two pins is the same as the height of the plurality of metal pins, wherein an air gap is present waveguide and the plurality of metal pins on one side and the upper planar metal plate;

wherein four corners are defined around an area where the two transmission lines cross each other, two of the four corners are diagonally opposite to each other, and each of the two of the four corners comprises a chamfered corner with a chamfer edge;

wherein each of the two pins has a respective surface opposite to the chamfer edge of a respective one of the two chamfered corners.

10. The center-structure module as claimed in claim 9, wherein the chamfer edge of each of the two chamfered corners has an inclined surface, and each of the two pins has a shape of a triangular prism with one side surface of the triangular prism opposite to the inclined surface of the chamfer edge of a respective one of the two chamfered corners.

* * * * *